United States Patent [19]

Ozawa et al.

[11] Patent Number: 4,792,828

[45] Date of Patent: Dec. 20, 1988

[54] IMAGE FORMING APPARATUS FOR FORMING A PLURALITY OF IMAGE FROM DIFFERENT ORIGINALS ON ONE TRANSFER SHEET

[75] Inventors: Takashi Ozawa, Ichikawa; Yasuyoshi Yamamoto, Tokyo; Masashi Ohashi, Tokyo; Akiyoshi Kimura, Tokyo; Nobukazu Sasaki, Tokyo; Toshirou Kasamura, Yokohama; Atsushi Kubota, Machida; Tatsuya Shiratori, Yokohama; Toshihiko Kusumoto, Tokyo; Michiro Koike, Kawasaki; Ken Tanabe, Yokohami; Hidetoshi Tanaka, Yokohama, all of Japan

[73] Assignee: Canon Kabushiki Kaisha, Tokyo, Japan

[21] Appl. No.: 890,411

[22] Filed: Jul. 29, 1986

[30] Foreign Application Priority Data

Aug. 10, 1985 [JP] Japan ..... 60-176148

[51] Int. Cl.[4] ..... G03G 15/00

[52] U.S. Cl. ..... 355/14 R; 355/8; 355/55

[58] Field of Search ..... 355/8, 14 R, 14 SH, 355/55, 3 SH

[56] References Cited

U.S. PATENT DOCUMENTS

| | | | |
|---|---|---|---|
| 3,960,445 | 6/1976 | Drawe | 355/4 |
| 4,277,163 | 7/1981 | Ikesue et al. | 355/14 R |
| 4,505,579 | 3/1985 | Furvichi | 355/14 R X |
| 4,657,380 | 4/1987 | Hamano et al. | 355/14 R X |

FOREIGN PATENT DOCUMENTS

| | | |
|---|---|---|
| 59083 | 9/1982 | European Pat. Off. . |
| 3420316 | 12/1984 | Fed. Rep. of Germany . |
| 3618086 | 12/1986 | Fed. Rep. of Germany . |
| 1449354 | 9/1976 | United Kingdom . |
| 1450207 | 9/1976 | United Kingdom . |
| 2034247 | 6/1980 | United Kingdom . |

*Primary Examiner*—A. C. Prescott
*Assistant Examiner*—Jane Lau
*Attorney, Agent, or Firm*—Fitzpatrick, Cella, Harper & Scinto

[57] ABSTRACT

An image forming apparatus capable of effecting plural image forming operations on one transfer sheet includes an image transfer device for transferring an image on the transfer sheet, an image magnification changing mechanism for changing the magnification of the image to be transferred onto the transfer sheet, and a control device for controlling the magnification changing mechanism in accordance with deformation of the transfer sheet caused by an image forming operation on the transfer sheet, after a first image is formed on the transfer sheet and before a second image is formed on the same transfer sheet, whereby those images are correctly registered.

26 Claims, 11 Drawing Sheets

IMAGE FORMING APPARATUS FOR FORMING A PLURALITY OF IMAGE FROM DIFFERENT ORIGINALS ON ONE TRANSFER SHEET

FIELD OF THE INVENTION AND RELATED ART

The present invention relates to an image forming apparatus such as a copying machine and a printer, and more particularly, to an image forming apparatus wherein a plurality of image forming operations are effected on one and the same transfer material.

In a conventional image forming apparatus of this type, as shown in FIG. 1, a photosensitive member (not shown) is expose to image light from a first original 87, and the image formed on the photosensitive member is developed into a toner image on the photosensitive member. The toner image is transferred therefrom to a transfer sheet 17, which, in turn, is advanced to an image fixing device (not shown), where the toner image is fixed on thetransfer sheet by one or both of heat and pressure. Subsequently, the transfer sheet 17 now having the first image thereon is conveyed by conveying means to the image forming station, while on the other hand, the photosensitive member is expose to the image light from second, original 88 for the second image formation operation. Then, a toner image is formed on the photosensitive member and is developed. The toner image is transferred onto the same or opposite side of the transfer sheet 17 (in the shown example, the same side). Then, the second toner image is fixed by the image fixing device.

There is a problem in the conventional apparatus when plural image formations are effected on the same transfer material, because the transfer sheet is deformed as a result of being subjected to the image forming operation. More particularly, the transfer sheet is changed in its longitudinal (in the direction of movement or conveyance thereof) dimension and/or in the lateral (perpendicular to the longitudinal direction) dimension by the image forming process including the image fixing step and the transfer sheet conveying step. This occurs most frequently in the image fixing step wherein the toner image is fixed on the transfer sheet, because the application of heat or pressure in this step can change the water content or the like of the transfer sheet, resulting in a change in the dimension of the sheet in the longitudinal and lateral directions. The change can be elongation and contraction depending on the image fixing system.

FIG. 2 shows the dimensional change of the transfer sheet 100 having the longitudnnal dimension (length) L and the lateral dimension (width) D, wherein the direction of conveyance is indicated by an arrow Z. For example, by the first image forming process, the transfer sheet 100 contracts by $\Delta L$ and $\Delta D$ in the longitudinal and lateral directions, respectively. In this Figure, the broken lines depict the sheet without contraction. When the second image is formed on the thus contracted transfer sheet 100, the toner image is formed on the contracted transfer sheet 100, and therefoee, the first image and the second image are out of registration on the transfer sheet 100, even to such an extent that the image is partly omitted.

This problem is more conspicuous or significant when the same image is reproduced as different color toner images 101 and 102 which are superimposed. Furthermore, the similar problem arises in the case of duplex copy, that is, images are formed on both sides of the transfer sheet.

SUMMARY OF THE INVENTION

Accordingly, it is a principal object of the present invention to provide an image forming apparatus wherein the image registration is assured even when the dimensions of the transfer sheet change as a result of the image formation, in the case where plural image forming operations are effected on the same transfer sheet.

According to an embodiment of the present invention, there is provided an image forming apparatus capable of effecting plural image forming operations on one transfer sheet, comprising image transfer means for transferring an image on the transfer sheet; image magnification changing means for changing a magnification in which the image to be transferred onto the transfer sheet is formed; and control means for controlling the magnification changing means in accordance with deformation of the transfer sheet through an image forming operation on the transfer sheet.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 4:
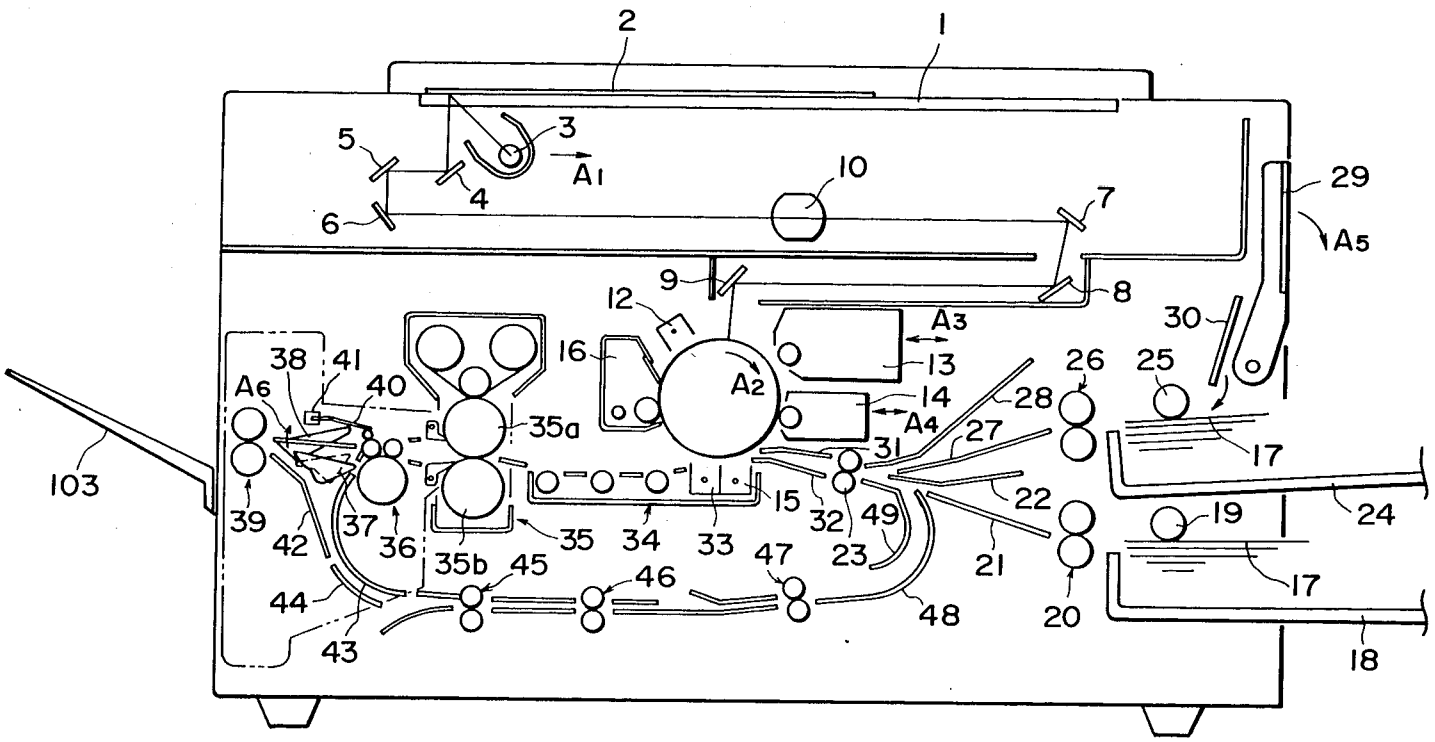
FIG. 4 is a side view of an image forming apparatus to which the present invention is applicable.

Referring now to FIG. 4, there is shown an example of the image forming apparatus to which the present invention is applicable, which is a copying machine capable of performing duplex copy operation and superimposing copy operations in different colors. An original 2 placed on an original platen glass 1 is illuminated by a lamp 3, and the resultant light image is introduced to a surface of a photosensitive drum 11 by way of an optical system comprising reflecting mirrors 4, 5, 6, 7, 8 and 9 and a zoom lens 10. The lamp 3, the mirror 4 and the mirrors 5 and 6 are movable in a direction indicated by an arrow A1 at predetermined speeds to scan the original 2. On the other hand, the photosensitive drum 11 is uniformly changed electrically by a primary charger 12, while being rotated in the direction of an arrow A2. When the surface of the photosensitive drum 11 is exposed to the image light sequentially, an electrostatic latent image is formed corresponding to the original image. Opposed to the photosensitive drum 11, there is a color dvveloping device 13 containing a color developer, for example, red or blue toner and a black developing device 14 containing the black developer. Those developing devices 13 and 14 are movable in the directions indicated by arrows A3 and A4, respectively, so that they can access the photosensitive drum 11, depending on the color to be reproduced, so as to visualize the electrostatic latent image on the photosensitive drum 11. In the state shown in this Figure, the color developing device 13 is away from the photosensitive drum 11, while on the other hand, the black developing device 14 is close thereto, so that the electrostatic latent image is developed by black toner on the photosensitive drum 11. The toner image is transferred onto transfer paper or sheet 17 as a transfer material. Subsequently, the surface of the photosensitive drum 11 is cleaned by a cleaner 16, whereby the toner remaining on the surface of the photosensitive drum 11 is removed to prepare for the next image forming operation.

The transfer sheet 17 is fed and conveyed in the following manner. The transfer sheet 17 is fed into the copying station in three ways. In the first way, the transfer sheet 17 is contained in a cassette 18 and fed by a pick-up roller 19 to the nip formed by a couple of rollers 20. The couple of rollers 20, when plural transfer sheets 17 are erroneously fed, functions to separate out the topmost sheet and feed the same into the copying station. The transfer sheet 17, after passing through the pair of rollers 20, reaches the registration roller pair 23 by way of guide plates 21 and 22. In the second way, the transfer sheet is accommodated in another cassette 24 and is fed therefrom by a pick-up roller 25 to a pair of rollers 26, which have the same function as the roller pair 20. The transfer sheet 17, after passing thoough the roller pair 26, reaches the same registration roller pair 23 by way of guide plates 27 and 28. The third way is a so-called manual feed. A manual feeding tray 29 is rotated in a direction indicated by an arrow A5, an intermediate plate 30 is inserted below the pick-up roller 25 with the rotation. At this time, the transfer sheet 17 in the cassette 24 is lowered so as not to interfere with the intermediate plate 30. The transfer sheet on the intermediate plate 30 and the manual feed tray 29 is fed to the registration roller 23 in the manner similar to the second way. The registration roller pair 23 starts rotating at such a timing that the visualized image on the photosensitive drum 11 is aligned with the transfer sheet 17, whereby the transfer sheet 17 is advanced to the surface of the photosensitive drum 11 between a top transfer sheet guide 31 and a bottom transfer sheet guide 32. As described hereinbefore, the transfer sheet receives the toner image from the surface of the photosensitive drum 11 with the aid of the transfer charger 15. Then, the transfer sheet 17 is separated from the surface of the photosensitive drum 11 by a separation charger 33, and in turn, advanced by way of the conveying portion 34 to the image fixing device 35 comprising a heating roller 35*a* and a pressing roller 35*b*. The image on the transfer sheet is heated and pressed by the fixing device 35 and is fixed into a permanent image. The transfer sheet 17 is then conveyed to a first pair of discharging rollers 36, and then conveyed to the second discharging roller pair 39 by way of a flapper 38. Finally, it is discharged out of the copying machine. In the Figure, the flapper 38 is shown as taking such a position to block the transfer sheet, but the material of the flapper 38 is light, and it is rotatable in a direction indicated by an arrow A6, so that it is raised upwardly by the leading edge of the transfer sheet and takes a retracted position so that it does not influence the passage of the transfer sheet 17 when the transfer sheet 17 passes.

The copying apparatus is capable of providing a duplex copy and superimposed copy.

When the duplex copy mode is selected, the transfer sheet 17 is processed in the same manner as described above so that an image of the original is formed and fixed on one side of the transfer sheet, and is discharged to a tray 103 through the second discharging roller pair 39. When the trailing edge of the transfer sheet is detected by a sheet detecting mechanism comprising a detecting lever 40 and a photosensor 41, and when a predetermined period of time elapses therefrom (the time period until the trailing edge of the transfer sheet passes by the flapper 38), the second discharging roller pair 39 rotates reversely so as to feed the transfer sheet back into the copying apparatus. The transfer sheet 17 is advanced with its trailing edge leading, to the roller pair 45 by way of the flapper 38, the bottom left inclined surface of the flapper 37, the guide plate 42 and the guide plates 43 and 44. Thereafter, the transfer sheet 17 reaches a lateral registration roller pair 47 through the roller pair 46. At this time, the lateral registration roller pair 47 is at rest. After the transfer sheet 17 completely abuts the roller pair 47, the roller pair 45 and 46 stop. The transfer sheet 17 is kept there waiting for the copying operation for the opposite side. Upon generation of the next copying signal, the lateral registration roller pair 47 starts rotating to advance the transfer sheet 17 to the registration roller pair 23 by way of guiding plates 48 and 49. Prior to the transfer sheet 17 reaching the registration roller 23, a lateral edge of the transfer sheet 17 is detected by an unshown photosensor, and the transfer sheet 17 is shifted laterally, that is, in the direction of the width of the transfer sheet, namely, in the direction perpendicular to the sheet of the drawing, by the lateral registration roller pair 47 so that the lateral edge of the transeer sheet takes the same position as when the first image is formed. The operations after the transfer sheet reaches the registration roller 23 are similar to the above described operations. After the image is formed on the second side of the transfer sheet 17, it is finally discharged onto the tray 103 by the second discharging roller pair 39.

On the other hand, when the superimposing copy operation is selected, the first copying operation is similar to the above described basic operation so that an image of the original is formed and fixed on one side of the transfer sheet. When the superimposing copy mode is selected, the flapper 37 takes the position shown by the broken lines. Therefore, the transfer sheet 17 is advanced, with its leading edge leading by the first discharging roller pair 36 and is conveyed to the guides 42 and 43 along the bottom right inclined surface of the flapper 37, and further to the roller pair 45 by way of the guides 43 and 44. Then, the transfer sheet 17 reaches the lateral registration roller pair 47 through the roller pair 46. When the trailing edge of the transfer sheet 17 is detected by the combination of the detecting lever 40 and the photosensor 41, and when a predetermined period of time elapses therefrom, the flapper 37 restores to the solid line position. Upon generation of the sccond copy signal, the lateral registration roller pair 47 starts rotating. At this time, the movement of the transfer sheet is similar to the case of the duplex copy. The transfer sheet 17 now having the second image on the same side thereof is finally discharged onto the tray by the second discharging roller pair 39. In this description, the example of superimposing two images is taken, but it will be understood that the movement of the transfer sheet is fundamentally the same when three or more images are superimposed, except that the restoring operation of the flapper 37 frmm the broken line position to the solid line position is carried out before the final image forming operation.

In the foregoing description, the duplex copy and the superimposed copy are produced one by one. However, the present invention is applicable to such an apparatus comprising a so-called intermediate tray, whrrein the duplex copies or the superimposed copies are produced en bloc.

The copying apparatus comprises the zoom lens 10 by which the magnification can be changed without changing the optical path length, by changing the position of a lens and the focal length.

Figure 5:
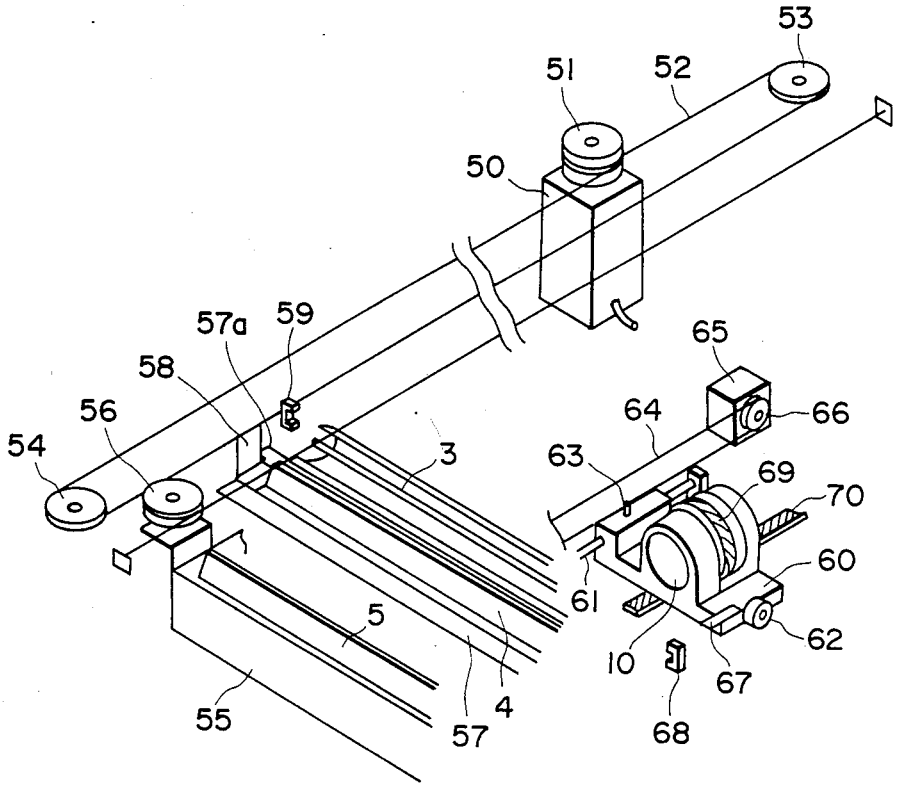
FIG. 5 is a perspective view of a driving mechanism for an optical system.

FIG. 5 shows a moving mechanism for the variable magnification optical system, which comprises a motor 50 for driving the mirrors. The motor 50 has an output shaft, to which a pulley 51 is fixed. Around the pulley 51 a wire 52 is trained, and the wire 52 is trained also around the pulleys 53 and 54 rotatably supported on the frame of the copying machine. The wire 52 is trained around and turned by a two-block pulley 56 rotatably supported on a supporting member 55 for the second mirror 5. The opposite ends of the wire 52 are fixed to the frame of the apparatus. On the other hand, a supporting member 57 for the first mirror 4 and the illuminating lamp 3 is fixed to the wire 52 by a mounting piece 58. The supporting member 57 has a projection 57*a*. The projection 57*a*is detected by a sensor 59 and controls mechanical operation. By the above described mechanism, the first mirror 4 is moved at a speed V, while the second and the third mirrors 5 are moved at the speed of V/2. In order that the scanning speed of the optical system correctly corresponds to the peripheral speed of the photosensitive member at a predetermined ratio, it is preferable to employ a speed-controllable DC or pulse motor as the motor 50.

A description will now be provided of a moving mechanism for the zoom lens. The zoom lens 10 is supported on the lens holder 60, which is movable by the combination of the rail 61 and a roller 62. The lens holder 60 is connected to a wire 64 by a mounting piece 63. By moving the wire 64 by the pulley 65 driven by the motor 65, the zoom lens 10 is movable. In this Figure, the pulley at the other end of the wire 64 is omitted for the sake of simplicity. The stopping position of the zoom lens 10 is determined by calculation on the basis of the position where the position detecting portion 67 provided on the holder 60 passes by the sensor 68. The focal length of the zoom lens 10 is changed in the following manner. A gear 69 is mounted to an unshown zoom ring and is meshed with a rack 70, so that the zoom ring is rotated together with movement of the zoom lens 10. Since the accuracy of the stop position of the zoom lens 10 influences to the quality of the image, the motor 65 has preferably the function of controlling braking. Therefore, a pulse motor is preferable.

Figure 6:
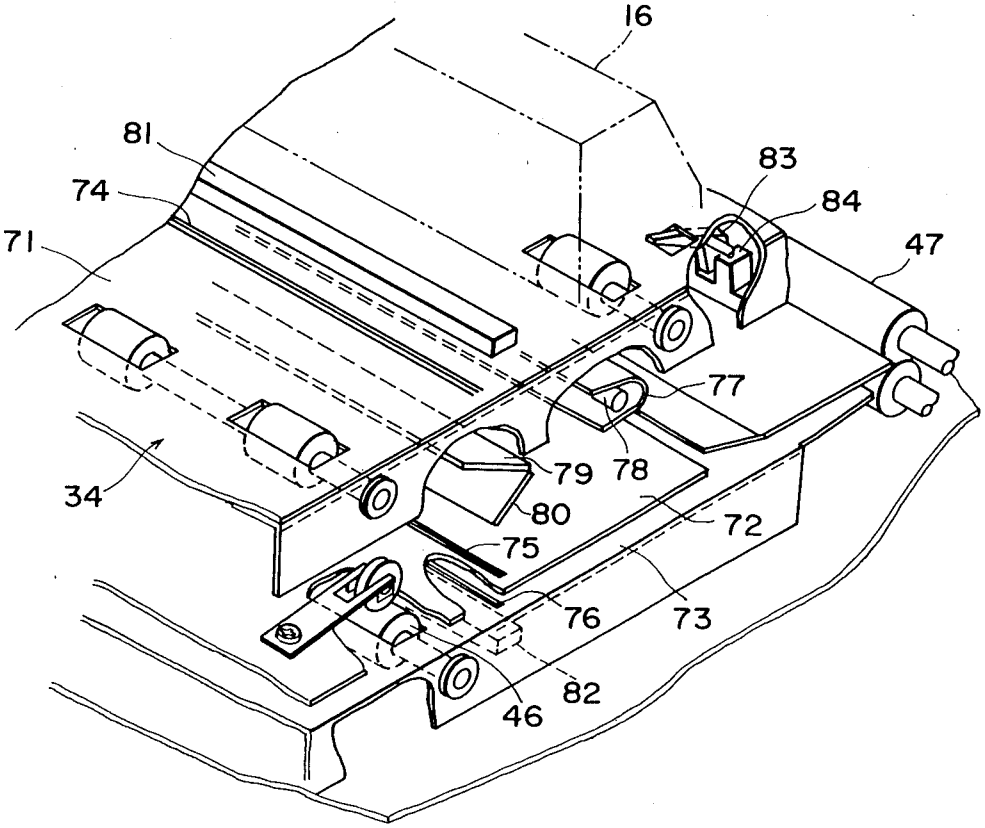
FIG. 6 is a perspective view of a detecting mechanism for detecting sizes of the transfer sheet.

FIG. 6 illustrates the mechanism for detecting the longitudinal and lateral dimensions of the transfer sheet.

First, a description will be provided of the measuring means for measuring the change of the lateral dimension of the transfer sheet, that is, the length of the transfer sheet measured in the direction perpendicular to the conveying direction Z. The mechanism comprises a plate 71 constituting the conveying portion 34 for conveying the transfer sheet 17 to the fixing device 35, and plates 72 and 73 constituting the conveying passage to convey the transfer sheet 17 back to the image forming station after it is subjected to the image fixing operation. Those plates 71, 72 and 73 are provided with slits extending in the lateral direction, that is, perpendicular to the conveying direction, the slits being aligned substantially vertically. Between the plates 71 and 72, a light source 78 and a reflecting mirrors 79 and 80 are interposed so as to illuminate the transfer sheet 17 when passing through the slits 74, 75 and 76, the light source 78 being provided with a shade 77. At the rear sides of the slits 74 and 76, photoreceptor units, for example, CCD units, (Charge Coupled Device) 81 and 82 are provided for receiving the light passed through the slits 74, 75 and 76. The photoreceptor units each include photoreceptor elements finely arranged in the lateral direction. When the transfer sheet 17 passes above the slit 74 during movement to the image fixing device 35, the photoreceptor elements of the photoreceptor unit 81 receive or do not receive the light, depending on the width of the transfer sheet 17 with the boundary corresponding to the lateral edge of the transfer sheet 17. The position of the boundary corresponds to the lateral dimension, that is, width of the transfer sheet 17 before it is subjected to the image fixing operation by the image fixing device 35. This is converted to electric signals, and is transmitted to a microprocessor unit (which will hereinafter be called MPU) 85. When the transfer sheet 17, after passing through the image fixing device 35, passes between the slits 75 and 76 during movement back to the image forming station, the lateral edge position of the transfer sheet 17 is detected by the photoreceptor unit 82 on the same principle. The electric signals are also transmitted to the MPU 85. And, the change in the lateral dimension of the transfer sheet 17 is calculated on the basis of these results of the detections.

Now, a description will be provided of the measurement of change in the longitudinal dimension of the transfer sheet 17, that is, the length thereof measured along the direction of conveyance of the transfer sheet. In the conveying portion 34 for conveying the transfer sheet 17 to the image fixing device 35 after the transfer sheet 17 receives the toner image, there are provided a detecting lever 83 which is inclined by the passing transfer sheet 17 and a photosensor 84 for optically detecting the state of inclination of the detecting lever 83. By the combination of the detecting lever 83 and the photosensor 84, the leading and trailing edges of the transfer sheet 17 are detected. When the transfer sheet 17 moves to the fixing device 35, it lowers the detecting lever 83 to incline it, which is detected by the photosensor 84, thus detecting the leading edge of the transfer sheet 17. When the trailing edge of the transfer sheet 17 passes by the detecting lever 83, the inclination of the detecting lever 83 is removed, and therefore, the trailing edge of the transfer sheet 17 is detected by the photosensor 84. The time difference between the leading edge detecting signal and the trailing edge detecting signal produced by the photosensor 84 corresponds to the longitudinal dimension of the transfer sheet 17. This time difference is inputted into the MPU 85. On other other hand, the transfer sheet 17 once subjected to the image fixing device, as shown in FIG. 4, is detected by the combination of the detecting lever 40 and the photosensor 41 located at the discharging portion, in such a manner that the leading and trailing edges of the transfer sheet 17 are detected. The leading edge detecting signal and the trailing edge detecting signal from the photosensor 41 are inputted to the MPU 85, which in turn, calculates the change in the longitudinal dimension of the transfer sheet 17 by the first image fixing operation, on the basis of the time difference between the leading edge and the trailing edge already stored in the memory and the time difference between the leading edge and the trailing edge provided by the photosensor 41.

Figure 7:
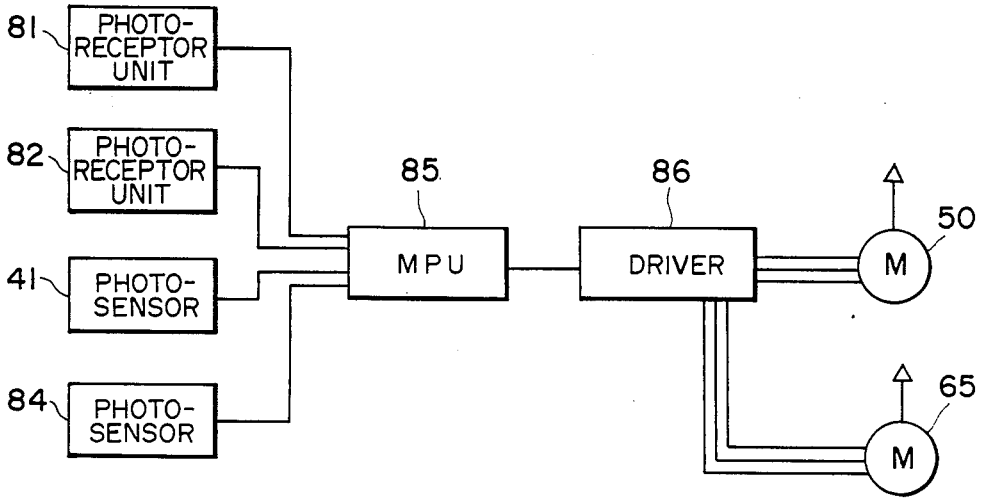
FIG. 7 is a block diagram illustrating a control system of an image forming apparatus according to a first embodiment of the present invention.

FIG. 7 is a block diagram illustrating the control system. The MPU 85 is connected with the photoreceptor units 81 and 82 and the photosensors 41 and 84. A driver 86 functions to drive the motors 50 and 65.

The operation of the above described apparatus will now be described.

Figure 1:
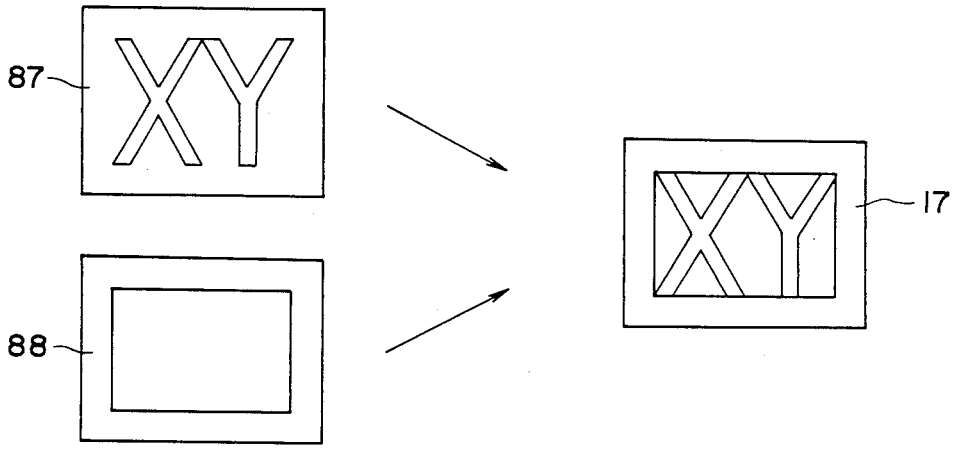
FIG. 1 is a plan view of a transfer sheet illustrating a relationship between an original and an image thereof on the transfer sheet.
Figure 2:
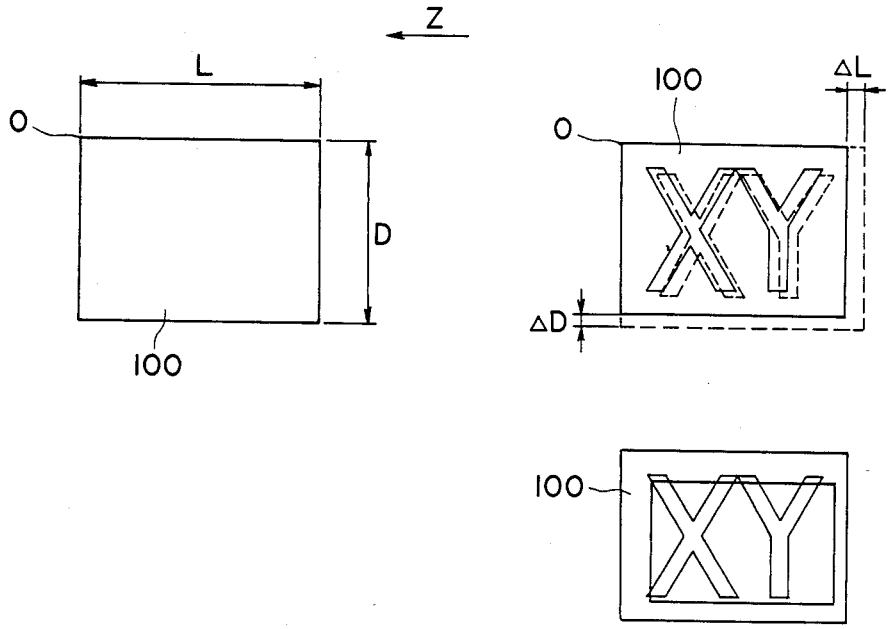
FIG. 2 is a plan view of a transfer sheet illustrating images not registered.
Figure 3:
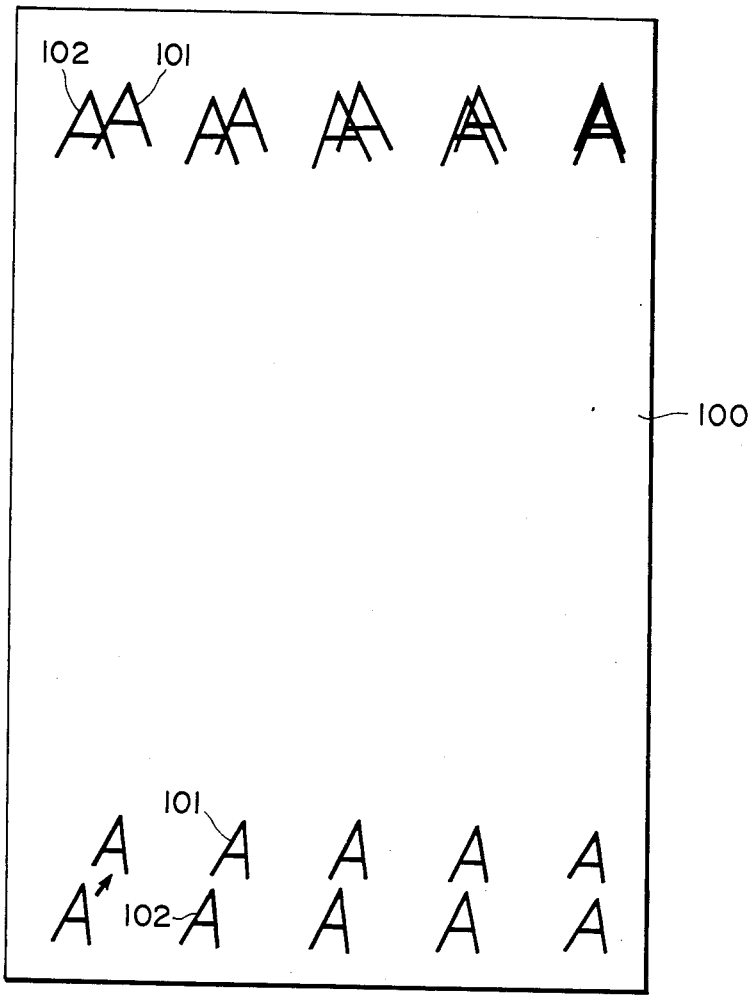
FIG. 3 is a plan view of a transfer sheet illustrating images not registered.
Figure 8:
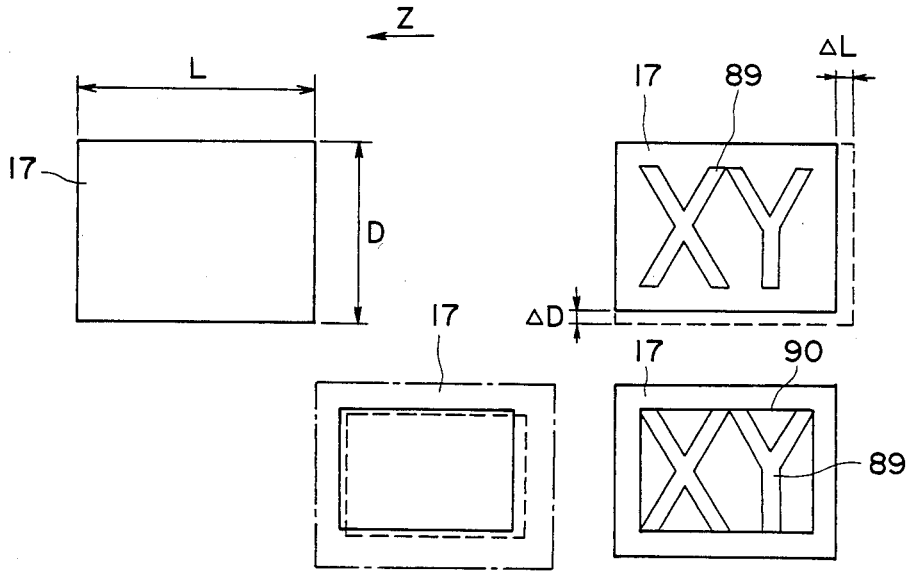
FIG. 8 is a plan view illustrating the process of image formation on the transfer sheet.

FIG. 8 shows the transfer sheet 17 to be used having a longitudinal dimension L and a lateral dimension D. A description will be provided of the case where two images, on the originals 87 and 88, respectively, as shown in FIG. 1, are superimposed. The transfer sheet used is accommodated in the cassette 18, and the original 87 first to be copied is placed on the platen glass 1. The operator selects on the operation panel (not shown) the copy magnification $M_1$ and a desired color, and then depresses an unshown copy button. The apparatus operates in the manner described above as the basic operation to provide a copy image having an image 89 on the transfer sheet 17. It is note that the dimensions of the transfer sheet 17 have changed through the image fixing step and conveying step, as shown in FIG. 1, that is, the longitudinal and lateral dimensions are reduced by $\Delta L$ and $\Delta D$, respectively. The amounts of contraction $\Delta L$ and $\Delta D$ are calculated by the MPU 85 on the basis of detection by the photoreceptor units 81 and 82 and photosensors 41 and 84. The MPU 85 further calculates the copy magnification to be set at the second copy operation on the basis of the amounts of contraction $\Delta L$ and $\Delta D$. More particularly, the new magnifications are $(L-\Delta L)M_1/L$ in the longitudinal direction and $(D-\Delta D)M_1/D$ in the lateral direction.

Then, the second original 88 is placed on the platen glass 1, and the desired color is selected. Upon depression of the copy button, the MPU 85 transmits a signal to the driver 86 so as to control the speed of the optical system and the position and focal length of the zoom lens 10. As to the longitudinal direction the motor 50 is controlled to change the speed of the optical system, while as to the lateral direction, the motor 65 is controlled to change the position and the focal length of the zoom lens 10, so as to provide the longitudinal magnification $MT=(L-\Delta L)M_1/L$ and the lateral magnification $ML=(D-\Delta D)M_1/D$. Then, the image forming operation is effected with respect to the second original. As a result, the second image is transferred onto the transfer sheet 17 already having the previously transfer image 89 with the image 89 be registered correctly with the previous image.

Figure 9:
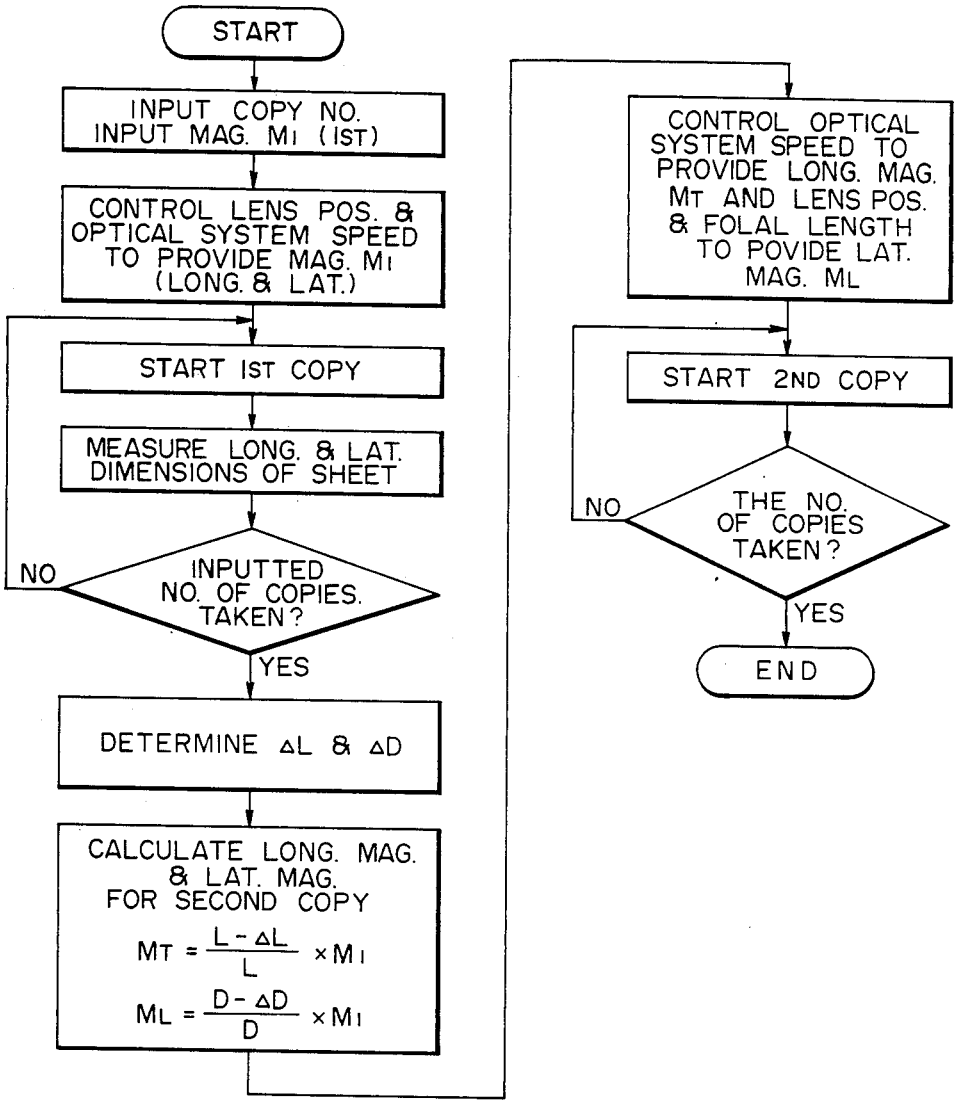
FIG. 9 is a flow chart illustrating the operation of the image forming apparatus according to a first embodiment of the present invention.

FIG. 9 is a flow chart illustrating the above described operation.

Now, a second embodiment of the present invention will be described, wherein the dimensional changes of the transfer sheet are not actually detected before the second image forming operation in order to change the copy magnification, but the magnification change is predetermined on the basis of the probable dimensional changes of the transfer sheet, and the second image formation is effected with the preset change of the magnification. This is based on the finding that the amounts of the dimensional change through the image forming process are almost determined by the used fixing device and fixing conditions, but they are substantially constant if the fixing device and fixing conditions are the same.

The following is a table containing data of dimensional changes of the transfer sheet of various sizes.

TABLE 1

| | SIZE LAT. × LONG. (mm) | AREAL WT. (g/m²) | PAPER MACHINE DIRECTION | LAT. CONTRACTION AMOUNT (mm) | LAT. CONTRACTION RATE (%) | LONG. CONTRACTION AMOUNT (mm) | LONG. CONTRACTION RATE (%) |
|---|---|---|---|---|---|---|---|
| A3 | 297 × 420 | 64 | LAT. | 0.28 | 99.91 | 0.15 | 99.97 |
| B4 | 257 × 364 | 64 | LAT. | 0.40 | 99.84 | 0.33 | 99.91 |
| A4 | 297 × 210 | 64 | LONG. | 0.68 | 99.77 | 0.25 | 99.88 |
| A4R | 210 × 297 | 64 | LONG. | 0.95 | 99.55 | 0.18 | 99.94 |
| B5 | 257 × 182 | 64 | LONG. | 0.61 | 99.76 | 0.35 | 99.81 |
| B5R | 182 × 257 | 64 | LONG. | 0.80 | 99.56 | 0.28 | 99.89 |
| LEDGER | 279.4 × 431.8 | 70 | LAT. | 0.80 | 99.71 | 0.28 | 99.93 |
| LEAGAL | 215.9 × 355.6 | 70 | LAT. | 0.71 | 99.67 | 0.30 | 99.92 |
| LETTER | 279.4 × 215.9 | 70 | LONG. | 0.31 | 99.89 | 0.50 | 99.57 |
| LETTER R | 215.9 × 279.4 | 70 | LONG. | 0.40 | 99.81 | 0.43 | 99.85 |
| | | | AVE. | 0.59 | 99.75 | 0.31 | 99.87 |
| | | | | | OVERALL AVE. | 0.45 | 99.81 |

As will be understood, the amounts of contraction in the longitudinal and lateral directions are different depending on the real weight, paper machine direction and the size of the transfer sheet. However, the amounts are within the range of 0.15–0.95 mm of the contraction and within 99.55–99.97% of the ratio of contraction, which average to 0.45 mm of the contraction and 99.81% of the contraction rate.

In this example relying on the act, the control is performed to provide the second copy magnification $M_2 = M_1 \times \alpha$ where $M_1$ (%) is the first copy magnification, and $\alpha$ is the contraction rate of the transfer sheet. On the basis of the above described data, $\Delta$ is set within the range of 0.9997–0.9955. In this embodiment, $\alpha$ is set to the average, that is, 0.9981.

Therefore, when, for example, the first copying operation is effected with the unit magnification, that is, $M_1$ is 100%, the second copy magnification $M_2 = 100 \times 0.9981 = 99.81\%$ is chosen. When the first copy magnification is 70% ($M_1 = 70\%$), the second magnification $M_2$ is set to $70 \times 0.9981 = 69.87\%$.

Figure 10:
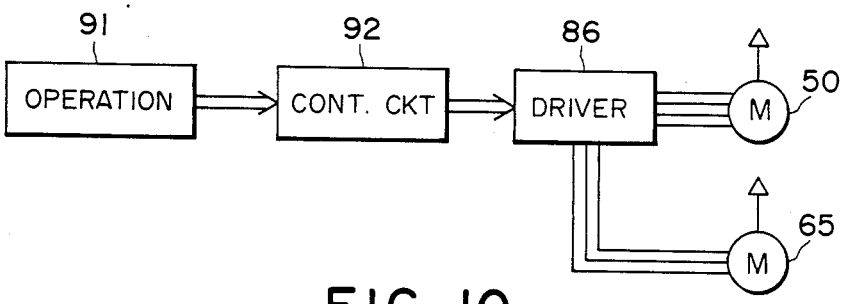
FIG. 10 is a block diagram illustrating a control system of the image forming apparatus according to a second embodiment of the present invention.

FIG. 10 is a block diagram illustrating a control system for the apparatus of this embodiment, wherein 91 is an operation panel, 92 is a control circuit, 86 is a driver for driving motors 50 and 65.

On the operation panel 91, the copy mode, the number of copies to be made and the copy magnification $M_1$ is inputted by keys. The control circuit 92 transmits signals to the driver 86 in accordance with the inputted pieces of information to drive the motors 50 and 65 to perform the first copy operation the number of set times in the selected mode under the selected magnification $M_1$. When the second copy signal is inputted into the control circuit 92, the control circuit 92 calculates the second copy magnification in accordance with the formula of $M_2 = M_1 \times \alpha$. Thereafter, the control circuit 92 transmits a signal to the driver 86 to drive the motors 50 and 65 to provide the second magnification $M_2$. Then, the second copy operation is effected on the same transfer sheet in the selected mode (superimposing mode or duplex mode).

Figure 11A:
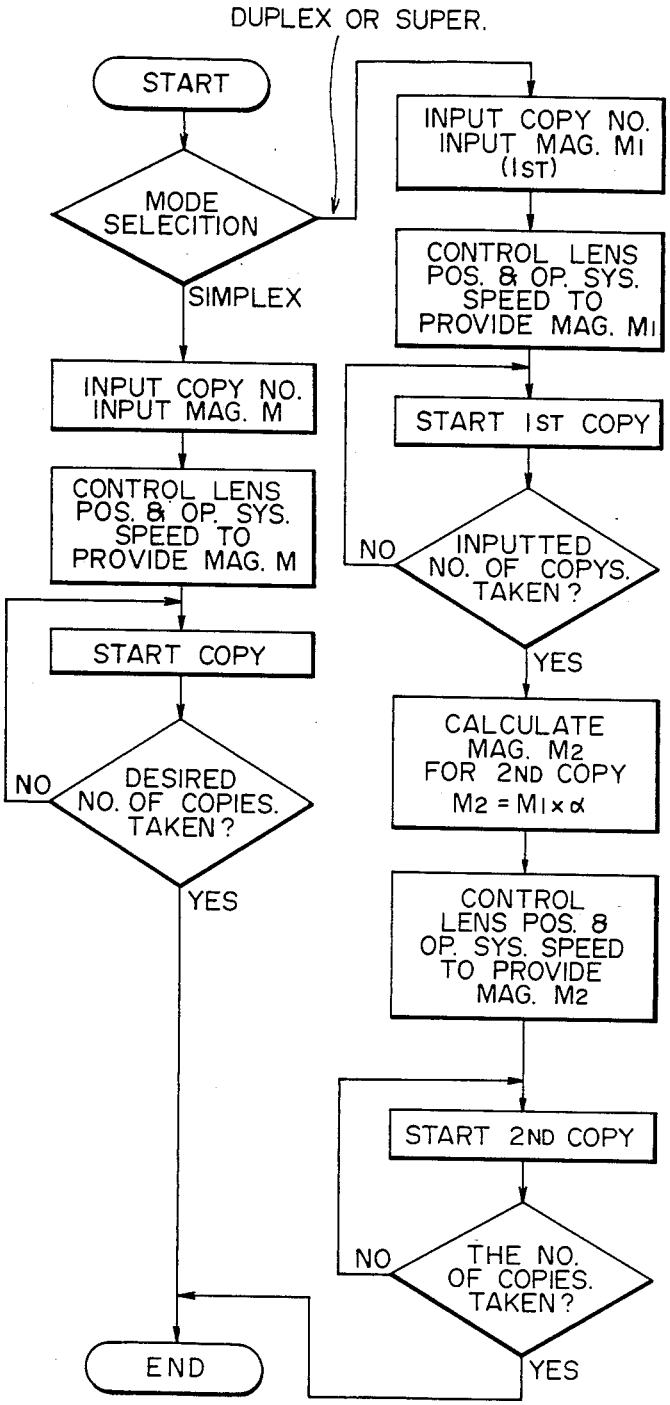
FIG. 11A is a flow chart illustrating the operation of the image forming apparatus according to the second embodiment of the present invention.

FIG. 11A is a flow chart illustrating the above described operation.

The other structures and operations are the same as in the first embodiment, and therefore, a detailed description will be omitted for the sake of simplicity.

In the second embodiment, the longitudinal magnification in the second copy magnification is equal to the lateral magnification of the second copy magnification. As will be understood from Table 1, the longitudinal magnification change ratio is different from the lateral one. Therefore, it is preferable to make different the longitudinal magnification and the lateral magnification in the second image forming operation. In order to do this, the longitudinal magnification MT is given by $M \times \beta$, while the lateral magnification ML is given by $M \times \gamma$, where M is the magnification in the first copy, $\beta$ is the contraction ratio in the longitudinal direction, and $\gamma$ is the contraction ratio in the lateral direction. According to Table 1, $\beta$ ranges from 0.9957 to 0.9997, and $\gamma$ ranges from 0.9955 to 0.9991, which average to $\beta = 0.9987$ and $\gamma = 0.9975$, respectively. These contraction ratios may be set to the averages. In this case, the control of the second copy magnification may be carried out in the same manner as with the first embodiment with the use of the control of the drive of the motors 50 and 65. However, the longitudinal magnification MT and the lateral magnification ML can be set previously, and therefore, a cylindrical lens may be employed which can be inserted across the image exposing light path and which has power to provide the longitudinal magnification MT and the lateral magnification ML.

Figure 11B:
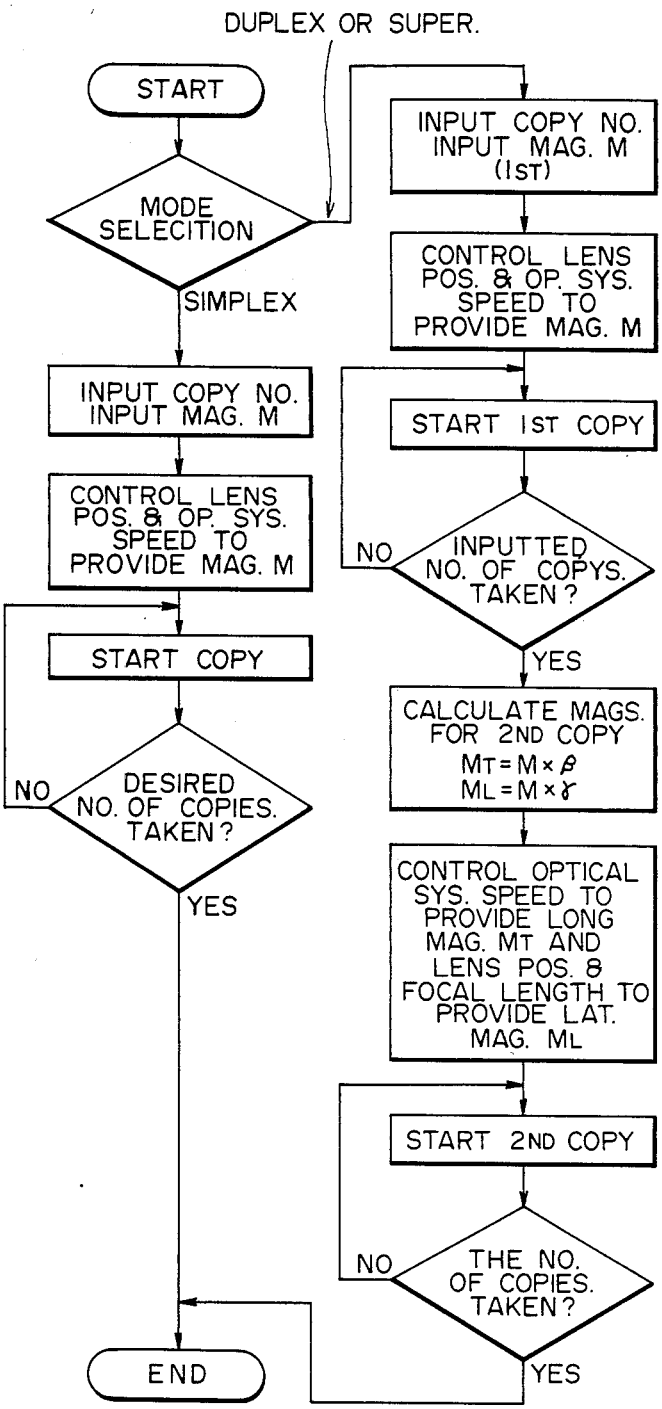
FIG. 11B is a flow chart illustrating the operation of the image forming apparatus according to a third embodiment of the present invention.

FIG. 11B is a flow chart illustrating this case.

In the second embodiment described above, the second copy magnification $M_2$ is determined on the basis of the average of the contraction ratio $\alpha$ of the data. It is a possible alternative that the second copy magnification may be changed depending on the size of the copy sheet, that is, the transfer sheet. In this case, the size of the transfer sheet is detected using the transfer sheet size selecting signal or a signal obtained from the cassette 18 containing a predetermined size of the transfer sheet to be used. The control circuit 92 stores the contraction ratio for each of the transfer sizes, on the basis of which the second copy magnification is controlled.

Figure 11C:
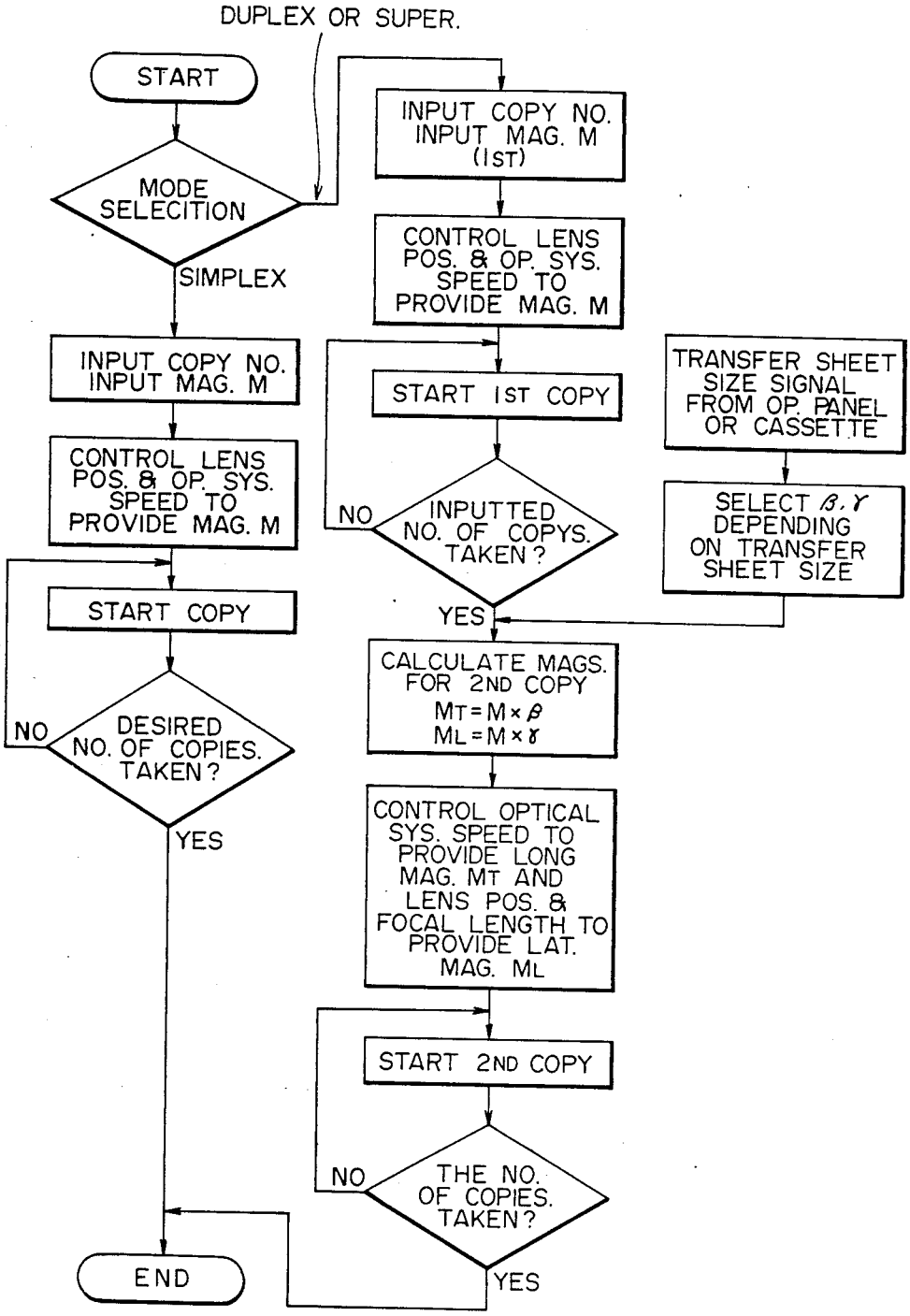
FIG. 11C is a flow chart illustrating the operation of the image forming apparatus according to a fourth embodiment of the present invention.

FIG. 11C is a flow chart illustrating this.

In the first and second embodiments, a signal is transmitted from the MPU 85 or control circuit 92 to the driver 86 so as to control the motors 50 and 65, by which the speed of the optical system is controlled for the longitudinal magnification control, while the posttion and the focal length of the zoom lens 10 is controlled for the purpose of controlling the lateral magnification, both for the change of the magnification in the second copy operation. However, this is not limiting, and the rotational speed of the photosensitive drum and the transfer sheet conveying speed can be changed for the purpose of the longitudinal magnification change, and for the lateral magnification change. A lens having a fixed focal length can replace the zoom lens; in this case the position of the fixed focal length lens is changed and the optical path is also changed for the purpose of the second copy operation.

Figure 12A:
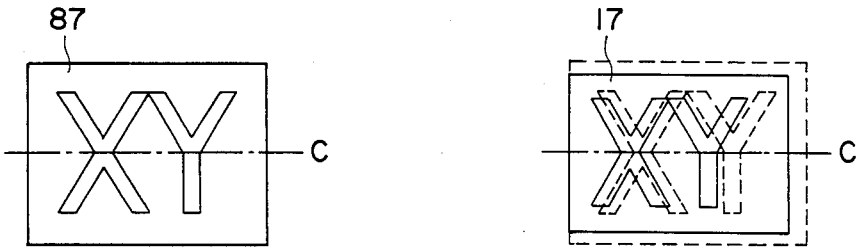
FIGS. 12A and 12B are plan views illustrating the relationship between the original image and the image formed on the transfer sheet when the centers thereof are registered.
Figure 12B:
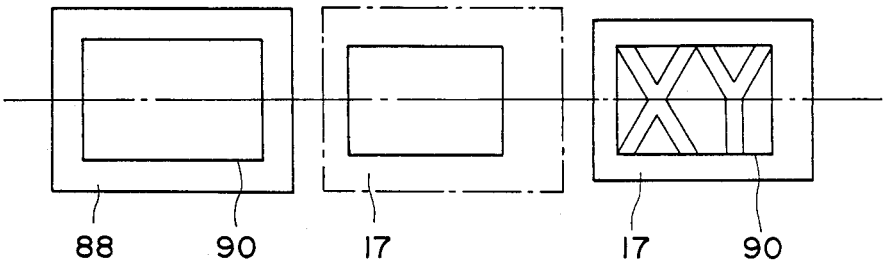

In the first example, the original and the transfer sheet are positioned using one edge as a reference edge. Therefore, the transfer sheet and the image change as shown in FIG. 1. If the central reference system is employed as shown in FIG. 12A, the same operation as with the first embodiment applies to this case, and the transfer sheet 17 and the image 90 change in the manner shown in FIG. 12B.

In the description of the first embodiment, the width of the transfer sheet is detected by the change of the light amount passing through the slit, but various alternatives can be employed in place thereof. For example, an image of the transfer sheet is projected onto a linear image sensor, which detects the width of the transfer sheet. The image sensor may be employed in order to detect the length of the transfer sheet. The positions of detection of the width or the length of the transfer sheet are not limited to those described above. Other positions may be used if they can detect the dimensional differences between before and after an image forming step resulting in the dimensional change.

In the first and second embodiments, the transfer sheet contracts by the image formation. It will be understood that the present invention is applicable to the case where the transfer sheet is elongated by one or more steps of the image formation.

The number of image formations on the same trnnsfer sheet is not limited to two, but it may be three or more.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus capable of effecting plural image forming operations on one transfer sheet, comprising:
image transfer means for transferring an image on the transfer sheet;
image magnification changing means for changing the magnification of the image to be transferred onto the transfer sheet; and
control means for controlling said magnification changing means in accordance with the deformation of the transfer sheet during an image forming operation on the transfer sheet.

2. An apparatus according to claim 1 wherein said magnification changing means changes the longitudinal magnification and the lateral magnification at the same rate.

3. An apparatus according to claim 1, wherein said magnification changing means includes longitudinal magnification changing means for changing the magnification in the longitudinal direction of the transfer sheet and lateral magnification changing means for changing the magnification in the lateral direction of the transfer sheet.

4. An apparatus according to claim 3, wherein said image forming apparatus includes:
original supporting means for supporting an original;
a photosensitive member for bearing a toner image to be transferred onto the transfer sheet; and
an optical system, including a lens, for scanning the original and exposing said photosensitive member to an image of the original, and wherein said longitudinal magnification changing means changes the longitudinal magnification by changing the ratio of the scanning speed of the optical system and the moving speed of the photosensitive member, and wherein said lateral magnification changing means changes the lateral magnification by changing the position of the lens.

5. An apparatus according to claim 1, wherein said image forming apparatus is capable of forming superimposed images on one side of the transfer sheet.

6. An image forming apparatus capable of effecting plural image forming operations on one transfer sheet, comprising:
image transfer means for transferring an image on the transfer sheet;
image magnification changing means for changing the magnification of the image to be transferred onto the transfer sheet;
deformation detecting means for detecting the amount of deformation of the transfer sheet resulting from an image forming operation; and
control means for controlling said magnification changing means on the basis of information detected by said deformation detecting means.

7. An apparatus according to claim 6, wherein said image forming apparatus includes fixing means for fixing the image transferred to the transfer sheet, and wherein said deformation means includes means for detecting the size of the transfer sheet after deformation, the means for detecting the size after deformation being disposed downstream of said fixing means with respect to a transfer sheet conveying direction.

8. An apparatus according to claim 7, wherein said deformation detecting means includes means for detecting the size of the transfer sheet before deformation, the means for detecting the size of the transfer sheet before deformation being disposed upstream of said fixing means with respect to a transfer sheet conveying direction.

9. An apparatus according to claim 6, wherein said deformation detecting means includes means for detecting the size of the transfer sheet before deformation and means for detecting the size of the transfer sheet after deformation, and wherein the amount of deformation of the transfer sheet is determined by comparing the sizes of the transfer sheet before and after the deformation.

10. An apparatus according to claim 6, wherein said magnification changing means includes longitudinal magnification changing means for changing the magnification in the longitudinal direction of the transfer sheet and lateral magnification changing means for changing the magnification in the lateral direction of the transfer sheet.

11. An apparatus according to claim 10, wherein said image forming apparatus includes:
original supporting means for supporting an original;
a photosensitive member for bearing a toner image to be transferred onto the transfer sheet; and
an optical system, including a lens, for scanning the original and exposing said photosensitive member to an image of the original, and wherein said longitudinal magnification changing means changes the longitudinal magnification by changing the ratio of the scanning speed of the optical system and the moving speed of a photosensitive member, and wherein said lateral magnification changing means changes the lateral magnification by changing the position of the lens.

12. An image forming apparatus capable of effecting plural image forming operations on one transfer sheet, comprising:
image transfer means for transferring an image on the transfer sheet;
image magnification changing means for changing the magnification of the image to be transferred onto the transfer sheet; and
control means for controlling said magnification changing means to change the magnification at a predetermined rate to effect the image forming operation at the changed magnification for the second and subsequent, if any, formation of the image to be transferred onto the transfer sheet.

13. An apparatus according to claim 12, wherein said magnification changing means includes longitudinal magnification changing means for changing the magnification in the longitudinal direction of the transfer sheet and lateral magnification changing means for changing the magnification in the lateral direction of the transfer sheet.

14. An apparatus according to claim 13, wherein said image forming apparatus includes:
original supporting means for supporting an original;
a photosensitive member for bearing a toner image to be transferred onto the transfer sheet; and
an optical system, including a lens, for scanning the original and exposing said photosensitive member to an image of the original, and wherein said longitudinal magnification changing means changes the longitudinal magnification by changing the ratio of the scanning speed of the optical system and the moving speed of the photosensitive member, and wherein siad lateral magnification changing means changes the lateral magnification by changing the position of the lens.

15. An apparatus according to claim 12, wherein said control means causes said magnification changing means to change the magnification at the same rate in the longitudinal direction and the lateral direction of the transfer sheet.

16. An apparatus according to claim 12, wherein said control means causes said magnification changing means to change the magnification in a longitudinal direction of the transfer sheet and a magnification in the lateral direction thereof at different rates.

17. An apparatus according to claim 12, wherein said control means causes said magnification changing means to change the magnification at different rates depending on the size of the transfer sheet.

18. An image forming apparatus capable of effecting plural image forming operations on one transfer sheet, comprising:

image transfer means for transferring an image on the transfer sheet;

fixing means for fixing the image transferred to the transfer sheet;

image magnification changing means for changing the magnification of the image to be transferred onto the transfer sheet; and control means for controlling said magnification changing means to change the magnification at a predetermined rate for a second formation of the image to be transferred onto the transfer sheet, wherein the transfer sheet passes through the fixing means before the second image formation.

19. An apparatus according to claim 18, wherein said magnification changing means includes longitudinal magnification changing means for changing the magnification in the longitudinal direction of the transfer sheet and lateral magnification changing means for changing the magnification in the lateral direction of the transfer sheet.

20. An apparatus according to claim 19, wherein said image forming apparatus includes:

original supporting means for supporting an original;

a photosensitive member for bearing a toner image to be transferred onto the transfer sheet; and an optical system, including a lens, for scanning the original and exposing said photosensitive member to an image of the original, and wherein said longitudinal magnification changing means changes the longitudinal magnification by changing the ratio of the scanning speed of the optical system and the moving speed of the photosensitive member, and wherein said lateral magnification changing means changes the lateral magnification by changing the position of the lens.

21. An apparatus according to claim 18, wherein said control means causes said magnification changing means to change the magnification at the same rate in the longitudinal direction and the lateral direction of the transfer sheet.

22. An apparatus according to claim 18, wherein said control means causes said magnification changing means to change the magnification in the longitudinal direction of the transfer sheet and the magnification in the lateral direction thereof at different rates.

23. An apparatus according to claim 18, wherein said control means causes said magnification changing means to change the magnification at different rates depending on the size of the transfer sheet.

24. An apparatus according to claim 7, wherein said fixing means includes heating means for fixing the image on the transfer sheets.

25. An apparatus according to claim 8, wherein said fixing means includes heating means for fixing the image on the transfer sheets.

26. An apparatus according to claim 18, wherein said fixing means includes heating means for fixing the image on the transfer sheets.

* * * * *

UNITED STATES PATENT AND TRADEMARK OFFICE

CERTIFICATE OF CORRECTION

PATENT NO. : 4,792,828

DATED : December 20, 1988

INVENTOR(S) : TAKASHI OZAWA, ET AL.

It is certified that error appears in the above-identified patent and that said Letters Patent is hereby corrected as shown below:

On the title page:

IN [54] TITLE

"IMAGE" should read --IMAGES--. (second occurrence)

COLUMN 1

Line 3, "IMAGE" should read --IMAGES--.
Line 26, "," should be deleted.
Line 52, "longitudnnal" should read --longitudinal--.

COLUMN 3

Line 23, "dvveloping" should read --developing--.
Line 68, "photos" should read --photo--.

COLUMN 5

Line 29, "frmm" should read --from--.
Line 35, "whrrein" should read --wherein--.

COLUMN 7

Line 19, "On other" should read --On the--.
TABLE 1, "LEAGAL" should read --LEGAL--.

COLUMN 9

Line 9, "$\Delta$" should read --$\alpha$--.

UNITED STATES PATENT AND TRADEMARK OFFICE

CERTIFICATE OF CORRECTION

PATENT NO. : 4,792,828

DATED : December 20, 1988

INVENTOR(S) : TAKASHI OZAWA, ET AL.

It is certified that error appears in the above-identified patent and that said Letters Patent is hereby corrected as shown below:

COLUMN 10

Lines 21 and 22, "posttion" should read --position--.

COLUMN 11

Line 59, "deformation means" should read --deformation detecting means--.

COLUMN 13

Line 8, "in a longitudinal" should read --in the longitudinal--.
Line 9, "and a magnification" should read --and the magnification--.

Signed and Sealed this

Seventeenth Day of July, 1990

*Attest:*

*Attesting Officer*

HARRY F. MANBECK, JR.

*Commissioner of Patents and Trademarks*